US008867935B2

(12) United States Patent
Kusumi

(10) Patent No.: US 8,867,935 B2
(45) Date of Patent: Oct. 21, 2014

(54) POWER CONTROL DEVICE, ELECTRONIC APPARATUS, AND IMAGE FORMING APPARATUS

(71) Applicant: Kyocera Document Solutions Inc., Osaka (JP)

(72) Inventor: Tadaharu Kusumi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 85 days.

(21) Appl. No.: 13/753,785

(22) Filed: Jan. 30, 2013

(65) Prior Publication Data

US 2013/0195498 A1 Aug. 1, 2013

(30) Foreign Application Priority Data

Jan. 30, 2012 (JP) ..... 2012-017351

(51) Int. Cl.
*G03G 15/00* (2006.01)
*H01H 7/00* (2006.01)

(52) U.S. Cl.
CPC ..... *H01H 7/00* (2013.01); *G03G 15/5004* (2013.01); *G03G 15/80* (2013.01)
USPC ..... 399/37; 399/88

(58) Field of Classification Search
USPC ..... 399/37, 88; 361/72, 195; 323/318
See application file for complete search history.

(56) References Cited

U.S. PATENT DOCUMENTS

| | | | | |
|---|---|---|---|---|
| 7,590,878 | B2 * | 9/2009 | Ren | 713/340 |
| 7,962,274 | B2 * | 6/2011 | Yonezawa et al. | 701/103 |
| 2003/0143503 | A1 * | 7/2003 | Wild et al. | 431/69 |
| 2006/0088330 | A1 * | 4/2006 | Fujita | 399/70 |

FOREIGN PATENT DOCUMENTS

JP 2000-244689 A 9/2000

* cited by examiner

*Primary Examiner* — Clayton E Laballe
*Assistant Examiner* — Leon W Rhodes, Jr.
(74) *Attorney, Agent, or Firm* — Pearl Cohen Zedek Latzer Baratz LLP

(57) ABSTRACT

A power control device includes a power control unit, a power switch, a timer unit, a power supply switch, and a connection instruction unit. The power control unit is driven by power supplied from a power source. The power switch outputs a detection signal to the power control unit. The timer unit outputs a switch-on signal for giving an instruction to turn on the switch. The power supply switch switches between connection and non-connection of the power source and a load. The connection instruction unit outputs a connection instruction signal for connecting the power source to the load. The power control unit outputs a stop signal for stopping the output of the switch-on signal to the timer unit before a time point at which the predetermined time elapses when the power is supplied from the power source. The power control unit outputs the switch-on signal to the connection instruction unit.

9 Claims, 5 Drawing Sheets

POWER CONTROL DEVICE, ELECTRONIC APPARATUS, AND IMAGE FORMING APPARATUS

INCORPORATION BY REFERENCE

This application is based upon and claims the benefit of priority from the corresponding Japanese Patent Application No. 2012-017351, filed in the Japan Patent Office on Jan. 30, 2012, the entire contents of which are incorporated herein by reference.

BACKGROUND

The present disclosure relates to a power control device, an electronic apparatus, and an image forming apparatus, and more particularly, to control when a power control unit controlling supply of power to a load is broken down.

According to the related art, electronic apparatuses such as image forming apparatuses driven by power of a commercial power source are configured such that the electronic apparatuses are prevented from operating when an alternating current (AC) cable is connected to the commercial power source. Such electronic apparatuses utilize a power control circuit that includes a power switch that switches between ON and OFF states of the electronic apparatus by a user and a CPU that detects an ON or OFF state of the power switch. In such a power control circuit, the CPU performs control such that the power of the commercial power source is supplied to each operation mechanism, when the AC cable is connected to the commercial power source by the user and it is then detected that the power switch enters an ON state by the user.

In regard to the power control circuit, a technology (referred to as "related technology 1") discloses a technology for not stopping supply of power to each operation mechanism as a load, for example, even when the CPU controlling the supply of the power is broken down. Related technology 1 is a technology for supplying the power from a discharging circuit during a reset operation of the CPU, even when the CPU becomes an abnormal state and is thus reset.

In the power control circuit disclosed in the related technology 1 described above, however, the reset of the CPU may not end within an expected reset time, for example, when the CPU may be completely broken down and the operation is disabled. For this reason, the CPU does not operate again. In this case, the supply of the power from the discharging circuit ends, and thus the supply of the power from the power control circuit to another module stops. For this reason, the user may not be informed of an abnormal state of the power control device or an abnormal state (operation-disabled state) of an electronic apparatus operating by the supply of the power from the power control device by driving a display or the like.

SUMMARY

According to a first disclosure, a power control device includes a power control unit, a power switch, a timer unit, a power supply switch, and a connection instruction unit.

The power control unit is connected to a power source and is driven by power supplied from the power source. The power switch is connected to the power source and outputs a detection signal to the power control unit, when a switch enters an ON state by a user. The timer unit is connected to the power source and outputs a switch-on signal for giving an instruction to turn on the switch at a time point at which a predetermined time has elapsed from a start time point of supply of the power from the power source. The power supply switch is installed on a wiring connecting the power source to a load and switches between connection or non-connection of the power source and the load. The connection instruction unit outputs a connection instruction signal for connecting the power source to the load to the power supply switch, when the switch-on signal is input from at least one of the power control unit and the timer unit. The power control unit outputs a stop signal for stopping the output of the switch-on signal to the timer unit before a time point at which the predetermined time elapses when the power is supplied from the power source, and the power control unit outputs the switch-on signal to the connection instruction unit, when the detection signal is input from the power switch.

According to a second disclosure, an electronic apparatus includes the power control device, and an informing unit and a control unit that drives and controls the informing unit, that serves as a load supplied with power from the power control device. The control unit outputs a confirmation signal to the power control unit when the control unit is activated by supply of the power from the power control device, the control unit starts a predetermined normal operation performed at a time of power input when the control unit receives a reply signal to the confirmation signal from the power control unit. The control unit causes the informing unit to inform of a warning of a user when the control unit does not receive the reply signal from the power control unit.

According to a third disclosure, an image forming apparatus includes the power control device, and an image forming unit that forms an image on a recording medium, an informing unit, and a control unit that drives and controls the informing unit, that serves as a load supplied with power from the power control device. The control unit outputs a confirmation signal to the power control unit when the control unit is activated by supply of the power from the power control device, the control unit starts a predetermined normal operation performed at a time of power input when the control unit receives a reply signal to the confirmation signal from the power control unit. The control unit causes the informing unit to inform of a warning of a user when the control unit does not receive the reply signal from the power control unit.

DETAILED DESCRIPTION

Figure 1:
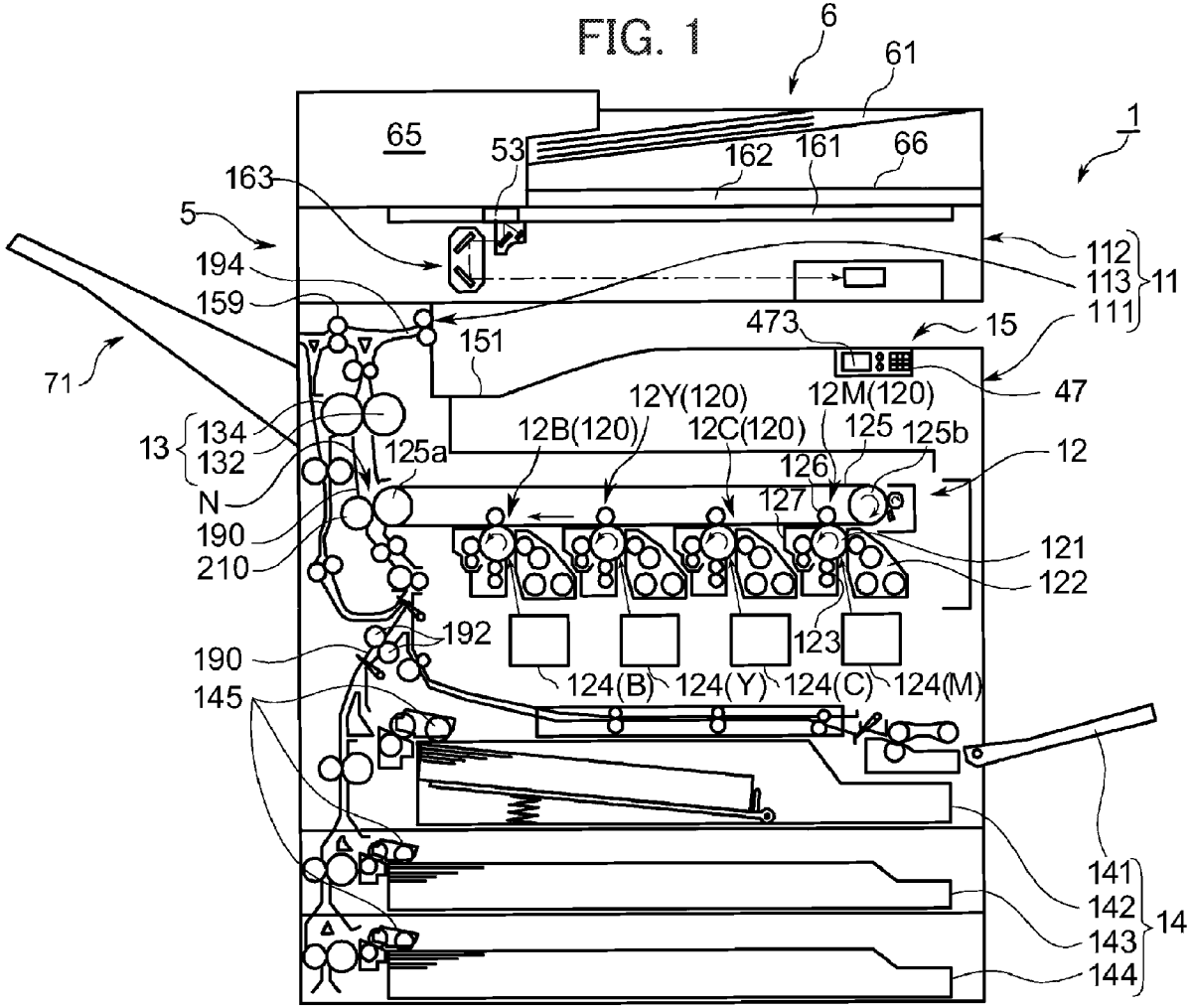
FIG. 1 is a sectional view illustrating the configuration of an image forming apparatus including a power control device according to an embodiment of the disclosure.

Hereinafter, a power control device and an image forming apparatus according to a first embodiment of the disclosure will be described with reference to the drawings. FIG. 1 is a sectional view illustrating the configuration of the image forming apparatus including the power control device according to the embodiment of the disclosure.

An image forming apparatus 1 is, for example, a multi-functional apparatus that has a plurality of functions such as a copy machine function, a printer function, a scanner function, and a facsimile function. The image forming apparatus 1 includes a power control device according to the first embodiment of the disclosure.

That is, the image forming apparatus 1 is configured to include a display unit 473, an image forming unit 12, a fixing unit 13, a sheet-feeding unit 14, a sheet-discharging unit 15, a document transporting unit 6, an image reading unit 5, and the power control device in an apparatus body 11. The power control device supplies power to the display unit 473, the image forming unit 12, the fixing unit 13, the sheet-feeding unit 14, the sheet-discharging unit 15, the document transporting unit 6, the image reading unit 5, and a control unit 20 (see FIG. 2). Destinations of power supply are merely examples, and the disclosure is not limited thereto (the same applies to the following description).

The apparatus body 11 includes a lower body 111, an upper body 112, and a connection section 113. The upper body 112 is disposed to face the upper side of the lower body 111. The connection section 113 is installed between the upper body 112 and the lower body 111. The upper body 112 includes the image reading unit 5 and the document transporting unit 6.

An operational unit 47 receives an instruction to perform various operations and processes executable by the image forming apparatus 1 from a user. The operational unit 47 includes an operational key unit. The operational unit 47 further includes the display unit 473. The operational unit 47 is configured by a liquid crystal display (LCD) including a touch panel.

The image reading unit 5 includes a contact glass 161 on which a document is placed, a document pressing cover 162, and a reading mechanism 163. The contract glass 161 is mounted on an upper surface opening of the upper body 112. The document pressing cover 162 is a cover that presses down a document placed on the contact glass 161 and can be opened and closed. The reading mechanism 163 is a mechanism that reads an image of a document placed on the contact glass 161.

The reading mechanism 163 optically reads an image of a document using an image sensor such as a charge coupled device (CCD) or a complementary metal oxide semiconductor (CMOS), and generates image data. The reading mechanism 163 is driven by power supplied from each regulator to be described below.

The document transporting unit 6 continues to feed a document placed on a document-placed portion 61 one by one by driving of a sheet-feeding roller and a transporting roller and transports the document to a position facing a document reading slit 53. The document transporting unit 6 transports the document so that the document can be read by the reading mechanism 163 of the image reading unit 5 via the document reading slit 53, and then discharges the document to the document-discharging unit 66. The reading mechanism 163 is located below the document reading slit 53. The reading mechanism 163 reads the document transported by the document transporting unit 6 via the document reading slit 53, when the document transported by the document transporting unit 6 is set to be read.

The lower body 111 includes the image forming unit 12, the fixing unit 13, and the sheet-feeding unit 14 therein. The sheet-feeding unit 14 includes sheet-feeding cassettes 142, 143, and 144 that can be inserted into and detached from the apparatus body 11.

The image forming unit 12 performs an image forming operation of forming a toner image on a recording sheet fed from the sheet-feeding unit 14. The image forming unit 12 includes an image forming unit 12M for magenta, an image forming unit 12C for cyan, an image forming unit 12Y for yellow, and an image forming unit 12B for black (hereinafter, referred to as image forming units 120, when it is not necessary to distinguish the image forming units from each other). The image forming unit further includes an intermediate transfer belt 125 and a secondary transfer roller 210.

The image forming unit 12M for magenta uses magenta toner. The image forming unit 12C for cyan uses cyan toner. The image forming unit 12Y for yellow uses yellow toner. The image forming unit 12B for black uses black toner. The image forming unit 12M for magenta, the image forming unit 12C for cyan, the image forming unit 12Y for yellow, and the image forming unit 12B for black are sequentially disposed from the upstream side to the downstream side of a travelling direction of the intermediate transfer belt 125.

The intermediate transfer belt 125 is formed in an endless form. The intermediate transfer belt 125 is suspended between a plurality of rollers such as a driving roller 125*a* (secondary transfer facing roller) so as to travel in a sub-scanning direction in image forming.

The secondary transfer roller 210 comes into contact with the outer circumferential surface of the intermediate transfer belt 125 in a portion in which the intermediate transfer belt 125 is suspended on the driving roller 125*a*.

Each image forming unit 120 integrally includes a photosensitive drum 121, a development device 122 that supplies toner to the photosensitive drum 121, a toner cartridge (not illustrated) that accommodates the toner, a charging device 123, an exposure device 124, a primary transfer roller 126, and a drum cleaning device 127.

An electrostatic latent image and a toner image formed according to the electrostatic latent image are formed on the circumferential surface of the photosensitive drum 121. The development device 122 supplies the toner to the photosensitive drum 121. The toner is appropriately supplied from the toner cartridge to each development device 122.

The charging device 123 is installed at a position immediately below the photosensitive drum 121. The charging device 123 uniformly charges the circumferential surface of each photosensitive drum 121.

The exposure device 124 is installed at a position below the photosensitive drum 121 and further below the charging device 123. The exposure device 124 radiates the circumferential surface of the charged photosensitive drum 121 with a laser beam corresponding to each color based on image data input from a computer or the like or image data acquired by the image reading unit 5. The exposure device 124 forms an electrostatic latent image on the circumferential surface of each photosensitive drum 121. The exposure device 124 is a so-called laser exposure device. The exposure device 124 includes a laser source that outputs a laser beam, a polygon mirror that reflects the laser beam toward the surface of the photosensitive drum 121, and an optical component such as a lens or a mirror that guides the laser beam reflected by the polygon mirror to the photosensitive drum 121.

The development device 122 supplies the toner to the electrostatic latent image on the circumferential surface of the photosensitive drum 121 rotated in a direction indicated by an arrow in FIG. 1 and stacks the toner on the circumferential surface of the photosensitive drum 121. The development device 122 forms a toner image on the circumferential surface of the photosensitive drum 121 according to the image data.

The intermediate transfer belt 125 is disposed at a position above each photosensitive drum 121. The intermediate transfer belt 125 is formed in an endless form. The intermediate transfer belt 125 is suspended between the driving roller 125*a* and a driven roller 125*b* so as to travel. The driving roller 125*a* is disposed on the left side in FIG. 1. The driven roller 125*b* is disposed on the right side in FIG. 1.

The lower-side outer circumferential surface of the intermediate transfer belt 125 comes into contact with the circumferential surface of each photosensitive drum 121. The driven roller 125*b* is installed at a position facing the driving roller 125*a*. The driven roller 125*b* is rotated with the travelling of the intermediate transfer belt 125. An image carrying surface to which the toner image is transferred is formed on the outer circumferential surface of the intermediate transfer belt 125. The intermediate transfer belt 125 is driven by the driving roller 125*a* in a contact state on the circumferential surface of the photosensitive drum 121. The intermediate transfer belt 125 travels between the driving roller 125*a* and the driven roller 125*b* in synchronization with each photosensitive drum 121.

The primary transfer roller 126 is installed at a position facing each photosensitive drum 121 with the intermediate transfer belt 125 interposed therebetween. A transfer bias is applied to the primary transfer roller 126 by a transfer bias applying mechanism (not illustrated). The primary transfer roller 126 transfers the toner image formed on the outer circumferential surface of each photosensitive drum 121 to the surface of the intermediate transfer belt 125.

The control unit 20 (see FIG. 2) drives and controls the primary transfer roller 126 and the image forming unit 120 for each color. The control unit 20 causes the transfer of the magenta toner image formed by the image forming unit 12M for magenta, the transfer of the cyan toner image formed by the image forming unit 12C for cyan, the transfer of the yellow toner image formed by the image forming unit 12Y for yellow, and the transfer of the black toner image formed by the image forming unit 12B for black to be performed in this order at the same position as the surface of the intermediate transfer belt 125 so that the toner images of the respective colors overlap each other. Thus, a color toner image is formed on the surface of the intermediate transfer belt 125 (intermediate transfer (primary transfer)).

A transfer bias is applied to the secondary transfer roller 210 by a transfer bias applying mechanism (not illustrated). The secondary transfer roller 210 transfers the color toner image formed on the surface of the intermediate transfer belt 125 to a recording sheet transported from the sheet-feeding unit 14. A nip portion N is formed between the secondary transfer roller 210 and the driving roller 125*a* with the intermediate transfer belt 125 interposed therebetween. In the nip portion N, the toner image is secondarily transferred to the recording sheet. The recording sheet transported along a sheet transporting path 190 is pressed and pinched in the nip portion N by the intermediate transfer belt 125 and the secondary transfer roller 210. In the nip portion N, the toner image on the intermediate transfer belt 125 is secondarily transferred to the recording sheet.

The drum cleaning device 127 is installed at a position on the left side of each photosensitive drum 121 in FIG. 1. The drum cleaning device 127 removes the toner remaining on the circumferential surface of the photosensitive drum 121 to clean the circumferential surface of the photosensitive drum 121.

In FIG. 1, the sheet transporting path 190 vertically extending is formed at a position on the left side of the image forming unit 12. A pair of transporting rollers 192 is installed at an appropriate position in the sheet transporting path 190. The pair of transporting rollers 192 transports the recording sheet continuously sent from the sheet-feeding unit 14 toward the nip portion N and the fixing unit 13. That is, the recording sheet is transported by a transporting mechanism formed by the pair of transporting rollers 192 disposed at the appropriate position.

The fixing unit 13 includes a heating roller 132 and a pressurizing roller 134. An energized heat generation body which is a heating source is included inside the heating roller 132. The pressurizing roller 134 is disposed to face the heating roller 132. The fixing unit 13 performs a process of fixing the toner image to the recording sheet by applying heat to the toner image on the recording sheet transferred by the image forming unit 12 from the heating roller 132, while the recording sheet passes through a fixing nip portion between the heating roller 132 and the pressurizing roller 134. After the process of fixing the toner image to the recording sheet is completed, the recording sheet on which a color image is formed is discharged to a discharging tray 151 through a sheet discharging and transporting path 194. The sheet discharging and transporting path 194 is installed to extend from the upper portion of the fixing unit 13. The discharging tray 151 is installed in the top portion of the lower body 111.

The sheet-feeding unit 14 includes a manual tray 141 and the sheet-feeding cassettes 142, 143, and 144. The manual tray 141 is installed on the right wall of the apparatus body 11 to be opened and closed in FIG. 1. Pickup rollers 145 are installed above the sheet-feeding cassettes 142, 143, and 144. The pickup roller 145 continues to feed the topmost recording sheet in a stack of sheets accommodated in each of the sheet-feeding cassettes 142, 143, and 144 toward the sheet transporting path 190.

The sheet-discharging unit 15 is formed between the lower body 111 and the upper body 112. The sheet-discharging unit 15 includes a discharging tray 151. The sheet-discharging unit 15 is formed on the upper surface of the lower body 111. The discharging tray 151 is a tray to which the recording sheet is discharged after the recording sheet on which the toner image is formed by the image forming unit 12 is subjected to the fixing process by the fixing unit 13.

Figure 2:
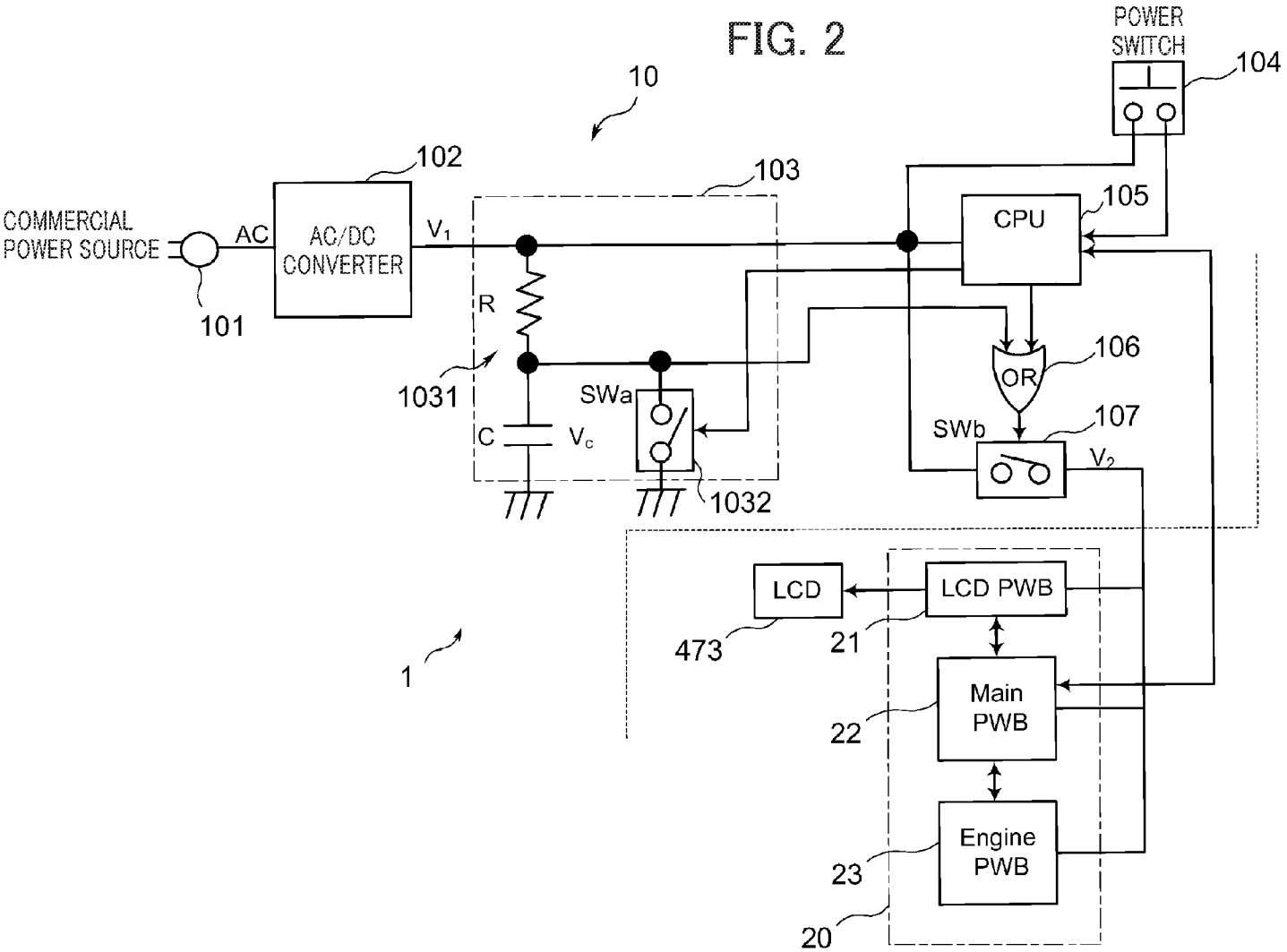
FIG. 2 is a block diagram illustrating the power control device according to the first embodiment.

Next, the power control device according to the first embodiment will be described. FIG. 2 is a block diagram illustrating the power control device according to the first embodiment.

A power control device 10 includes an AC cable 101, an AC-DC converter 102, a timer unit 103, a power switch 104, a power control unit 105, an OR circuit 106, and a power supply switch 107. The power control device 10 supplies power to the control unit 20, the display unit 473, the image forming unit 12, the fixing unit 13, the sheet-feeding unit 14, the sheet-discharging unit 15, the document transporting unit 6, the image reading unit 5, and the like as loads. The control unit 20, the display unit 473, the image forming unit 12, the fixing unit 13, the sheet-feeding unit 14, the sheet-discharging unit 15, the document transporting unit 6, and the image reading unit 5, and the like are installed in the image forming apparatus 1. The control unit 20 controls all of the operations of the image forming apparatus 1. In FIG. 2, only the control unit 20 and the display unit 473 are illustrated. The control unit 20 (which is an example of a control unit described in the claims) includes a display control unit 21, a main control unit 22, and an engine control unit 23.

The AC cable 101 includes a plug and a connecting code. The plug of the AC cable 101 is connected to an outlet which is a power supply port of a commercial power source (AC 100 V).

The AC-DC converter 102 converts an alternating current of a given voltage into a direct current of another voltage. For example, the AC-DC converter 102 converts an alternating-current voltage of 100 (V) of a commercial power source into a direct-current voltage of 5 (V) or 10 (V) and outputs the direct-current voltage (hereinafter, 5 (V) is used in the following description). The AC-DC converter 102 supplies direct-current power to the inside of the image forming apparatus 1. Each of the above-described loads needs the direct-current power.

The timer unit 103 is connected to the AC-DC converter 102 as a power source. The timer unit 103 includes an RC circuit 1031 and a changeover switch 1032.

The RC circuit 1031 is installed on a wiring connecting the AC-DC converter 102 as the power source to the ground. The RC circuit 1031 includes a resistor R and a capacitor C. The resistor R and the capacitor C are connected to each other in series. The resistance value of the resistor R is set to adjust a charging time of the capacitor C. The resistance value of the resistor R of the RC circuit 1031 is set to be a time constant in which a charging voltage $V_c$ of the capacitor C reaches a predetermined value when a predetermined time $t_b$ has elapsed from the start time point of the power supply from the AC-DC converter 102. The start time point of the power supply from the AC-DC converter 102 is a time point at which the AC-DC converter 102 supplies the power to the RC circuit 1031. The predetermined value of the charging voltage $V_c$ of the capacitor C is an H-level detection voltage of 2 (V) of the OR circuit 106 in this embodiment.

As the predetermined time $t_b$, any time longer than a time $t_a$ from a first time point $t_1$ to a second time point $t_2$ is set. The first time point $t_1$ is a time point at which the AC cable 101 is connected to a commercial power source by a user and the power is started to be supplied by the AC-DC converter 102. The second time point $t_2$ is a time point at which an output voltage $V_1$ of the AC-DC converter 102 reaches an operation voltage of 5 (V) of the power control unit 105, the power control unit 105 starts to be driven, and a connection instruction signal for connecting the RC circuit 1031 to the ground is output to the changeover switch 1032.

The resistor R and the capacitor C of the RC circuit 1031 are connected to the OR circuit 106. Due to this connection, a High-level detection voltage of 2 (V) output by the capacitor C can be input to the OR circuit 106. The OR circuit 106 is set to receive an output signal from the capacitor C as a Low signal, when the charging voltage $V_c$ does not reach the High-level detection voltage of 2 (V). The OR circuit 106 is set to receive an output signal from the capacitor C as a High signal which is a switch-on signal, when the charging voltage $V_c$ reaches the High-level detection voltage of 2 (V). In other words, the RC circuit 1031 outputs the switch-on signal to the OR circuit 106, when the charging voltage $V_c$ from the capacitor C reaches the predetermined value.

The changeover switch 1032 is, for example, a semiconductor switch. The changeover switch 1032 is installed between a wiring connecting the RC circuit 1031 to the OR circuit 106 and the ground. The changeover switch 1032 switches between connection or non-connection between the RC circuit 1031 and the ground in response to an instruction from the power control unit 105. That is, the changeover switch 1032 switches between charging or discharging of the capacitor C of the RC circuit 1031 under the control of the power control unit 105.

The power switch 104 is, for example, a toggle switch. The power switch 104 is a main power switch of the image forming apparatus 1. The power switch 104 is connected to the AC-DC converter 102 as the power source and the power control unit 105. When a switch enters a switch-on state by a user's operation, the power switch 104 outputs a detection signal indicating that the switch-on state is detected to the power control unit 105. That is, the power switch 104 receives an instruction indicating whether the power from the AC-DC converter 102 is supplied to each of the above-described loads inside the image forming apparatus 1 in response to a user's operation on the power switch 104.

The power control unit 105 includes a CPU. The power control unit 105 is connected to the AC-DC converter 102 as the power source. The power control unit 105 is driven by the power supplied from the AC-DC converter 102. The power control unit 105 performs changeover control of whether the power supplied from the AC-DC converter 102 is supplied to the loads. For example, the power control unit 105 controls a switching operation performed by the changeover switch 1032. The power control unit 105 outputs, to the OR circuit 106, a switch-on signal (a High signal in this embodiment) for giving an instruction to switch on the power supply switch 107. The power control unit 105 performs communication or the like with the engine control unit 23.

High signals (switch-on signal) or the Low signals are input from the timer unit 103 (the RC circuit 1031) and the power control unit 105 to the OR circuit (connection instruction unit) 106. The OR circuit 106 outputs a logical addition of the High signals or the Low signals input from the timer unit 103 (the RC circuit 1031) and the power control unit 105 as a connection instruction signal (a High signal in this embodiment) to the power supply switch 107. The connection instruction signal (the High signal in this embodiment) is a signal for connecting the AC-DC converter 102 as the power source to the load. That is, the OR circuit 106 outputs the connection instruction signal (High signal) to the power supply switch 107, when the switch-on signal (High signal) from at least one of the power control units 105 or the timer unit 103 is input.

The power supply switch 107 is installed on a wiring connecting the AC-DC converter 102 as the power source and the load installed inside the image forming apparatus 1. The power supply switch 107 connects the AC-DC converter 102 to the load, when the connection instruction signal (High signal) is input from the OR circuit 106. The power supply switch 107 does not connect the AC-DC converter 102 to the load, when the connection instruction signal is not input from the OR circuit 106 (when the Low signal is input). That is, the power supply switch 107 performs the switching operation of switching between the supply or the non-supply of the power from the AC-DC converter 102 to the load depending on presence or absence of the connection instruction signal from the OR circuit 106.

The display control unit 21 is a board that includes a control circuit controlling driving of the display unit (informing unit) 473 illustrated in FIG. 1. The main control unit 22 is a board that includes a main control circuit performing operation control of the entire image forming apparatus 1. The main control unit 22 performs a process such as a process of ensuring synchronization between operation mechanisms and an image processing on an image to be formed. The engine control unit 23 is a board that includes a control circuit driving and controlling, for example, a device such as a motor generating motive power. For example, the device such as a motor generating motive power grants a driving force to the transporting roller 192 and the driving roller **125*b* described above. The display control unit 21, the main control unit 22, and the engine control unit 23 are driven by a voltage (power) of DC 5 (V) supplied from the AC-DC converter 102**.

Figure 3:
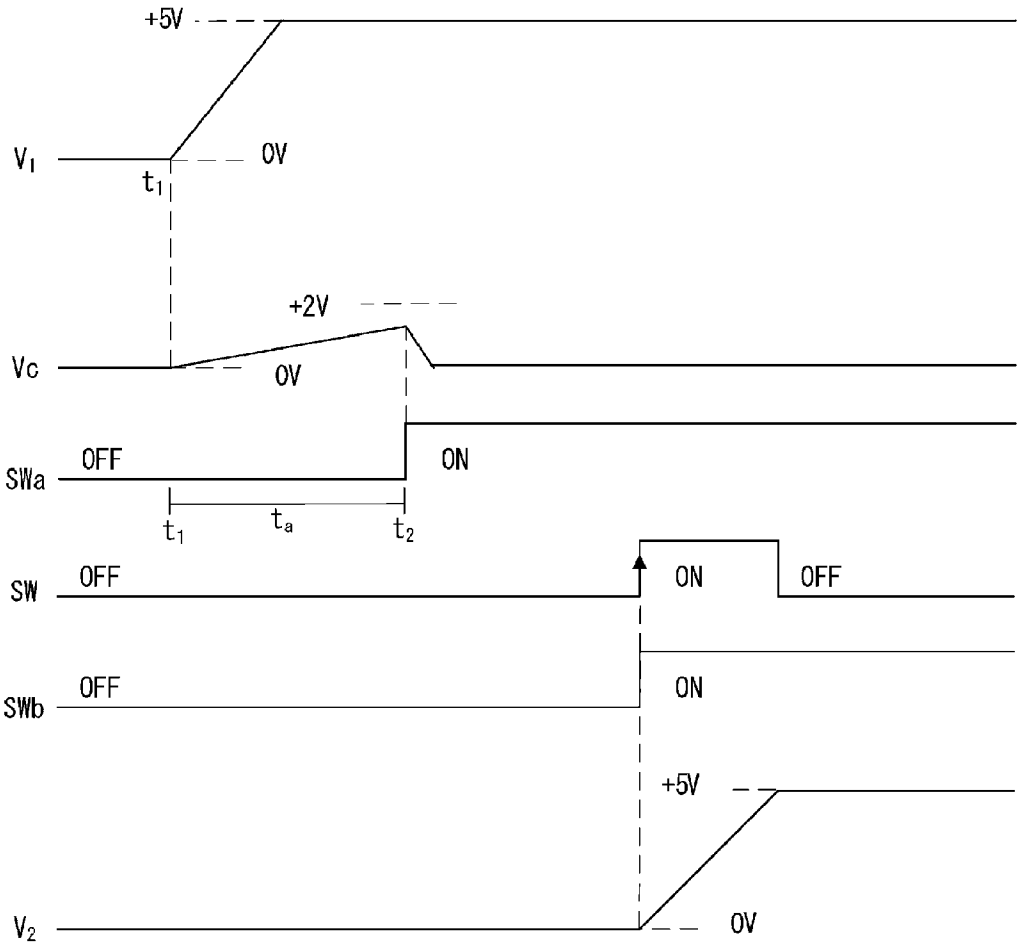
FIG. 3 is a diagram illustrating a timing chart when supply of power is controlled by the power control device and when the power control unit normally operates.

Next, control of power supply by the power control device 10 and control when the power control unit 105 normally operates will be described with reference to FIGS. 2 and 3. FIG. 3 is a diagram illustrating a timing chart when the supply of the power is controlled by the power control device 10 and when the power control unit 105 normally operates.

When the AC cable 101 is connected to the outlet of the commercial power source by the user ($t_1$ in $V_1$ in FIG. 3), the AC-DC converter 102 generates and outputs a voltage (power) of DC 5 (V) from a voltage (power) of AC 100 (V) supplied from the commercial power source ($V_1$ in FIG. 3). At this time, the output voltage $V_1$ of the AC-DC converter 102 increases from 0 (V) to 5 (V).

When the output voltage $V_1$ of the AC-DC converter 102 is applied to the RC circuit 1031 of the timer unit 103, the capacitor C of the RC circuit 1031 starts charging. Thus, the charging voltage $V_c$ of the capacitor C increases based on the time constant at the set time by the resistance value of the resistor R ($V_c$ in FIG. 3). That is, the charging voltage $V_c$ of the capacitor C increases at a change speed at which the charging voltage $V_c$ of the capacitor C reaches a predetermined value (H-level detection voltage of 2 (V)), when the above-described predetermined time $t_b$ has elapsed from the first time point (the supply time point of the power) $t_1$ which is the start time point of the supply of the power by the AC-DC converter 102.

On the other hand, the power control unit 105 starts to be driven by the supply of the power of DC 5 (V) from the AC-DC converter 102. The power control unit 105 outputs the connection instruction signal for connecting the RC circuit 1031 to the ground to the changeover switch 1032, while the above-described time $t_a$ has elapsed from the first time point $t_1$ at which the driving starts by the supply of the power from the AC-DC converter 102 ($Sw_a$ in FIG. 3).

As described above, the time $t_a$ is set to be shorter than the predetermined time $t_b$. Therefore, a switching operation of connecting the RC circuit 1031 to the ground is performed by the changeover switch 1032 in accordance with the connection instruction signal from the power control unit 105 at the second time point $t_2$ before the charging voltage $V_c$ of the capacitor C reaches the predetermined value (the High-level detection voltage of 2 (V)). Thus, the capacitor C starts discharging ($V_c$ in FIG. 3). The charging voltage $V_c$ of the capacitor C is lowered toward 0 (V) due to the discharging of the capacitor C.

The power control unit 105 waits for an input of the detection signal from the power switch 104, after outputting the connection instruction signal to the changeover switch 1032. When the power switch 104 enters the switch-on state in response to a user's operation, the power switch 104 outputs the detection signal to the power control unit 105 (Sw in FIG. 3).

When the detection signal is input from the power switch 104, the power control unit 105 outputs a switch-on signal (High signal) for giving an instruction to switch on the power supply switch 107 to the OR circuit 106.

At this time, the switch-on signal (High signal) is input from the power control unit 105 to the OR circuit 106. On the other hand, the voltage $V_c$ of the capacitor C lowered to the extent that the voltage $V_c$ does not reach the predetermined value 2 (V). Therefore, the switch-on signal (High signal) is not input and the Low signal is input from the timer unit 103 (the RC circuit 1031). The OR circuit 106 outputs a logical addition of the High signals or the Low signals input from the timer unit 103 (the RC circuit 1031) and the power control unit 105. Therefore, under such a condition, the OR circuit 106 outputs the connection instruction signal (High signal) for connecting the AC-DC converter 102 as the power source to the load to the power supply switch 107. That is, the OR circuit 106 outputs the connection instruction signal (High signal) to the power supply switch 107, when the switch-on signal (High signal) from at least one of the power control unit 105 and the timer unit 103 is input ($Sw_b$ in FIG. 3).

The power supply switch 107 connects the AC-DC converter 102 as the power source to each of the above-described loads in accordance with the connection instruction signal (High signal). Due to this connection, in regard to the output voltage $V_2$ from the power supply switch 107 to the load, the voltage (power) of DC 5 (V) from the AC-DC converter 102 increases up to 5 (V). That is, the power is supplied to each mechanism (load) of the image forming apparatus 1 by the voltage (power) of DC 5 (V) from the AC-DC converter 102.

The main control unit 22 outputs, to the power control unit 105, a confirmation signal indicating that the main control unit 22 is activated, when the driving starts by the supply of the power. When a replay signal to the confirmation signal is returned from the power control unit 105 to the main control unit 22, the main control unit 22 transmits an instruction to start a predetermined normal operation (for example, a predetermined normal operation such as an aging operation) at the time of an power input to the display control unit 21 and the engine control unit 23. The main control unit 22, the display control unit 21, and the engine control unit 23 start the predetermined normal operation in response to this instruction.

Figure 4:
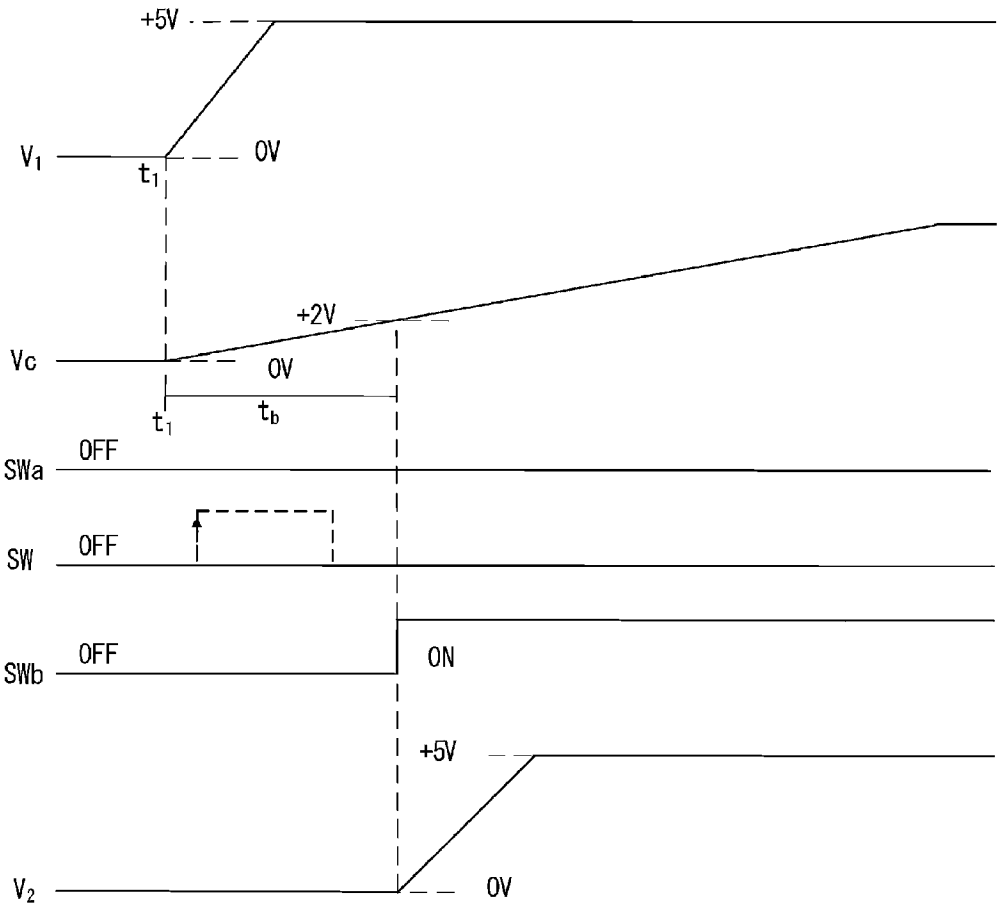
FIG. 4 is a diagram illustrating a timing chart when the supply of the power is controlled by the power control device and when the power control unit does not normally operate.

Next, control of power supply by the power control device 10 and control when the power control unit 105 does not normally operate will be described with reference to FIGS. 2 *and* 4. FIG. 4 is a diagram illustrating a timing chart when the supply of the power is controlled by the power control device 10 and when the power control unit 105 does not normally operate. The description of the same process as the control when the power control unit 105 normally operates will not be repeated.

When the AC cable 101 is connected to the outlet of the commercial power source by the user (timing $t_1$ in FIG. 4) and the output voltage $V_1$ of the AC-DC converter 102 is applied to the RC circuit 1031 of the timer unit 103, the capacitor C of the RC circuit 1031 starts charging. At this time, the charging voltage $V_c$ of the capacitor C transitions to the time constant set by the resistance value of the resistor R ($V_c$ in FIG. 4).

On the other hand, the power control unit 105 does not operate due to the breakdown, although the power control unit 105 is supplied with the voltage (power) of DC 5 (V) by the AC-DC converter 102. Therefore, the power control unit 105 does not output the connection instruction signal to the changeover switch 1032 ($Sw_a$ in FIG. 4). Therefore, the switching operation of connecting the RC circuit 1031 to the ground by the changeover switch 1032 is not performed. Therefore, the capacitor C does not perform discharging and the charging continues by the transition of the time constant ($V_c$ in FIG. 4).

At this time, even when the power switch 104 enters the switch-on state through a user's operation and the power switch 104 outputs the detection signal to the power control unit 105 (SW in FIG. 4), the operation of the power control unit 105 is disabled. Thus, the power control unit 105 does not output the switch-on signal.

When the charging of the capacitor C continues and thus the charging voltage $V_c$ of the capacitor C reaches the High-level detection voltage of 2 (V) ($V_c$ in FIG. 4), the switch-on signal (High signal) is input from the timer unit 103 to the OR circuit 106.

At this time, the switch-on signal (High signal) is not input from the power control unit 105 to the OR circuit 106 and the switch-on signal (High signal) is input only from the timer unit 103 (the RC circuit 1031). The OR circuit 106 outputs a logical addition of the High signals or the Low signals input from the timer unit 103 (the RC circuit 1031) and the power control unit 105. Therefore, the OR circuit 106 outputs the connection instruction signal (High signal) to the power supply switch 107 based on the input of the switch-on signal (High signal) from the timer unit 103 ($Sw_b$ in FIG. 4).

The power supply switch 107 connects the AC-DC converter 102 as the power source to each of the above-described loads in accordance with the connection instruction signal (High signal). Thus, even when the detection signal from the power switch 104 operated by the user may not be detected due to the operation disabled due to the breakdown or the like of the power control unit 105, the power is forcibly supplied to each mechanism of the image forming apparatus 1 ($V_2$ in FIG. 4).

The main control unit 22 outputs the confirmation signal to the power control unit 105, when the driving starts by the supply of the power. However, since the operation of the power control unit 105 is disabled, a reply signal to the confirmation signal is not returned to the main control unit 22. The main control unit 22 enters a standby state without start of the normal operation at the time of power input, when the reply signal to the confirmation signal is not received. Further, the main control unit 22 outputs an instruction for forcible activation to the display control unit 21. The display control unit 21 receives the instruction for the forcible activation and displays a warning message to the display unit 473. The warning message is, for example, a message for prompting the user to input the power again or a message indicating that an error occurs.

Figure 5:
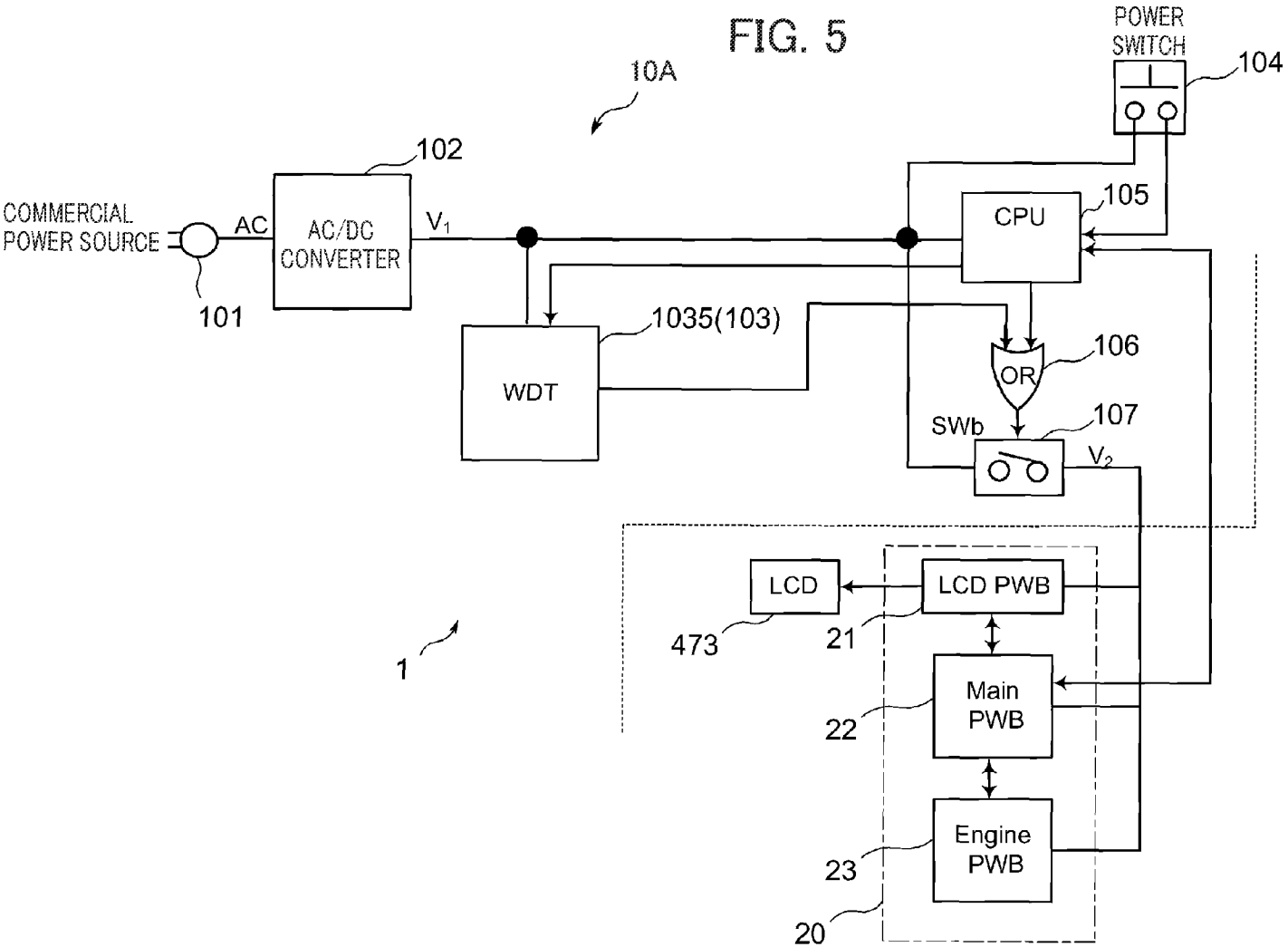
FIG. 5 is a block diagram illustrating a power control device according to a second embodiment.

Next, a power control device according to a second embodiment will be described. FIG. 5 is a block diagram illustrating a power control device according to the second embodiment. The description of the same configuration as that of the first embodiment will not be repeated.

In a power control device 10A according to the second embodiment, a timer unit 103 includes a watchdog timer 1035 instead of the RC circuit 1031 and the changeover switch 1032.

The watchdog timer 1035 starts timing, when a power of the AC-DC converter 102 as a power source is supplied. The watchdog timer 1035 is set to output the switch-on signal (High signal) to an OR circuit 106, when the watchdog timer 1035 times the elapse of a predetermined time $t_b$.

When an AC cable 101 is connected to a commercial power source by a user and an AC-DC converter 102 starts supplying power, an output voltage $V_1$ of the AC-DC converter 102 reaches an operation voltage of 5 (V) of a power control unit 105. Then, the power control unit 105 starts to be driven. When the driving of the power control unit 105 starts, the power control unit 105 outputs, as a stop signal, a reset signal for resetting a timing time to the watchdog timer 1035. The predetermined time $t_b$ is set to be longer than a time $t_a$. The time $t_a$ is a time from a time point, at which the power control unit 105 is supplied with the power by the AC-DC converter 102 and starts to be driven, to the output time of the reset signal.

The watchdog timer 1035 reset the timing from the supply time point of the power by the reset signal from the power control unit 105.

Control of power supply by the power control device 10A according to the second embodiment and control when the power control unit 105 normally operates will be described with reference to FIG. 5.

When the AC cable 101 is connected to the outlet of the commercial power source by the user and the AC-DC converter 102 outputs a voltage (power) of DC 5V, the watchdog timer 1035 is activated by the voltage (power) of DC 5 (V). Then, the watchdog timer 1035 starts timing, when the voltage (power) of DC 5 (V) is supplied.

On the other hand, the power control unit 105 starts to be driven by the supply of the voltage (power) of DC 5 (V) from the AC-DC converter 102. The power control unit 105 outputs a reset signal for resetting the timing to the watchdog timer 1035 from the start time point of the driving by the supply of the power from the AC-DC converter 102 to the elapse time of the time $t_b$.

As described above, the time $t_a$ is set to be shorter than the predetermined time $t_b$. Therefore, before the watchdog timer 1035 times the predetermined time $t_b$, the timing of the watchdog timer 1035 is reset by the reset signal from the power control unit 105. That is, the watchdog timer 1035 does not output the switch-on signal (High signal) to the OR circuit 106.

The power control unit 105 outputs a switch-on signal (High signal) for giving an instruction to turns on the power supply switch 107 to the OR circuit 106, when the power control unit 105 outputs the reset signal to the watchdog timer 1035 and then receives the detection signal from the power switch 104 due to the fact that the power switch 104 enters the switch-on state by a user's operation.

At this time, the OR circuit 106 outputs a logical addition of the High signals or the Low signals input from the timer unit 103 (the watchdog timer 1035) and the power control unit 105. Therefore, the OR circuit 106 outputs the connection instruction signal (High signal) for connecting the AC-DC converter 102 as the power source to the load to the power supply switch 107.

The power supply switch 107 connects the AC-DC converter 102 as the power source to the display control unit 21 or the like as the above-described load in accordance with the connection instruction signal (High signal). Thus, the power is supplied to each mechanism of the image forming apparatus 1, and thus the image forming apparatus 1 is driven.

Control of power supply by the power control device 10A according to the second embodiment and control when the power control unit 105 does not normally operate will be described with reference to FIG. 5.

When the AC cable 101 is connected to the outlet of the commercial power source by the user and the AC-DC converter 102 outputs a voltage (power) of DC 5 (V), the watchdog timer 1035 is activated. The watchdog timer 1035 starts timing, when the power is supplied.

On the other hand, when the power control unit 105 is supplied with the voltage (power) of DC 5 (V) by the AC-DC converter 102, the power control unit 105 does not operate due to the breakdown. Therefore, the power control unit 105 does not output the reset signal to the watchdog timer 1035. Therefore, the watchdog timer 1035 continues the timing. The watchdog timer 1035 outputs the switch-on signal (High signal) to the OR circuit 106, when the watchdog timer 1035 times the elapse of the predetermined time $t_b$.

The switch-on signal (High signal) is not input from the power control unit 105 to the OR circuit 106 and the switch-on signal is input only from the timer unit 103 (the watchdog timer 1035). The OR circuit 106 outputs a logical addition of the High signals or the Low signals input from the timer unit 103 (the watchdog timer 1035) and the power control unit 105. Therefore, the OR circuit 106 outputs the connection instruction signal (High signal) to the power supply switch 107 based on the input of the switch-on signal (High signal) from the timer unit 103.

Thus, even when the detection signal from the power switch 104 operated by the user may not be detected due to the operation disabled due to the breakdown of the power control unit 105, the power is forcibly supplied to each mechanism of the image forming apparatus 1.

Thus, in the above-described embodiments, the power control unit 105 outputs the switch-on signal to the OR circuit 106, when the power switch 104 enters the switch-on state by the user and the detection signal is input from the power switch 104. The power control unit 105 causes the power supply switch 107 to connect the AC-DC converter 102 as the power source to the load, and thus ensures that it is possible to prevent a situation in which an electronic apparatus including the power control device operates immediately when connected to a commercial power source.

When the power control unit 105 normally operates, the power control unit 105 outputs the connection instruction signal (or the reset signal) as a stop signal to the timer unit 103 (the watchdog timer 1035), before the power is supplied from the AC-DC converter 102 as the power source and the predetermined time $t_b$ elapses. Further, the OR circuit 106 outputs the connection instruction signal for connecting the power source to the load to the power supply switch 107 not based on the switch-on signal from the timer unit 103 (the watchdog timer 1035) but based on the switch-on signal output by the power control unit 105. Thus, when the power control unit 105 normally operates, the power is not forcibly supplied to the load after the supply start of the power from the AC-DC converter 102 as the power source, and the power control unit 105 can perform control of whether the power of the AC-DC converter 102 as the power source is supplied to the load depending on the ON state or the OFF state of the power switch 104.

Even in the case in which the power control unit 105 is broken down after the supply of the power from the AC-DC converter 102 as the power source and the power control unit 105 may not detect the input of the detection signal from the power switch 104, the OR circuit 106 outputs the connection instruction signal in accordance with the switch-on signal from the timer unit 103 (the watchdog timer 1035) when the predetermined time $t_b$ has elapsed. The power supply switch 107 connects the AC-DC converter 102 as the power source to the load. Therefore, even when the power control unit 105 is broken down, the power is supplied to the load. The user can be informed of an abnormal state. The user is informed of the abnormal state by causing the display control unit 21 to drive an informing device such as the display unit 473.

Thus, it is possible to prevent the situation in which the image forming apparatus 1 operates immediately when the supply of the power starts due to, for example, the connection to the commercial power source. Further, even when the power control unit 105 including the CPU is completely broken down and the operation is disabled, the supply of the power to the load can be enabled and the user can be informed of the abnormal state by the informing device such as a display.

The configurations and advantages of the present disclosure are summarized as follows. In the present disclosure, the power control unit outputs the switch-on signal to the connection instruction unit and causes the power supply switch to connect the power source to the load, when the power switch enters the switch-on state by the user and the detection signal is input from the power switch. Thus, it is possible to prevent the situation in which an electronic apparatus including the power control device operates immediately when connected to a commercial power source or the like.

When the power control unit normally operates, the power control unit outputs the stop signal to the timer unit, and causes the timer unit not to output the switch-on signal, before the power is supplied from the power source and the predetermined time elapses. The connection instruction unit causes the power supply switch to connect the power source to the load only based on the switch-on signal output by the power control unit. Thus, when the power control unit normally operates, the power is not forcibly supplied to the load after the supply start of the power from the power source and the power control unit can perform the control of whether the power of the power source is supplied to the load depending on the ON state or the OFF state of the power switch.

In a case in which the power control unit is broken down after the supply of the power from the commercial power source and the input of the detection signal from the power switch may not be detected, the connection instruction unit outputs the connection instruction signal to the power supply switch in accordance with the switch-on signal from the timer unit so that the power can be connected to the load when the predetermined time has elapsed. Thus, even when the power control unit is broken down, the power is supplied to the load and the user can be informed of the abnormal state by driving an informing unit included in the electronic apparatus.

Thus, it is possible to prevent the situation in which the electronic apparatus operates immediately when the supply of the power starts due to the connection or the like to the commercial power source. Moreover, the power can be supplied to the load and the informing unit such as a display can inform the user of the abnormal state, even when the power control unit such as a CPU is completely broken down and the operation is disabled.

In the present disclosure, there are provided the RC circuit as the timer unit and the changeover switch that switches between the connection and non-connection of the RC circuit and the ground. At the time of a normal operation, when the power is supplied from the power source, the power control unit connects the RC circuit and the ground to the changeover switch by outputting the connection instruction signal to discharge the capacitor before the charging voltage of the RC circuit reaches the predetermined value. Thus, without using a complex device or circuit, it is possible to prevent the situation in which an electronic apparatus operates immediately when the supply of the power starts, and compatibly the power can be supplied to the load when the power control unit is broken down.

In the present disclosure, the timer unit includes the watchdog timer and the power control unit outputs the reset signal to the watchdog timer to reset the watchdog timer before the predetermined time elapses, when the power is supplied from the power source. Thus, without using a complex device or circuit, it is possible to prevent the situation in which an electronic apparatus operates immediately when the supply of the power starts, and compatibly, the power can be supplied to the load when the power control unit is broken down.

The disclosure can be modified in various ways without limitation on the configurations of the above-described embodiments. For example, in the above-described embodiments, the power control device 10 or 10A is configured to be mounted on the image forming apparatus 1, but the disclosure is not limited thereto. The power control device 10 or 10A may be mounted on another electronic apparatus and supply power to each mechanism of the electronic apparatus.

The configurations and processes described in the above-described embodiments with reference to FIGS. 1 to 5 are merely examples of the disclosure. Configurations and processes of the present disclosure are not limited thereto.

The invention claimed is:

1. A power control device comprising:

a power control unit that is connected to a power source and is driven by power supplied from the power source;

a power switch that is connected to the power source and outputs a detection signal to the power control unit, when a switch enters an ON state by a user;

a timer unit that is connected to the power source and outputs a switch-on signal for giving an instruction to turn on the switch at a time point at which a predetermined time has elapsed from a start time point of supply of the power from the power source;

a power supply switch that is installed on a wiring connecting the power source to a load and switches between connection or non-connection of the power source and the load; and a connection instruction unit that outputs a connection instruction signal for connecting the power source to the load to the power supply switch, when the switch-on signal is input from at least one of the power control unit and the timer unit, wherein the power control unit outputs a stop signal for stopping the output of the switch-on signal to the timer unit before a time point at which the predetermined time elapses when the power is supplied from the power source, and the power control unit outputs the switch-on signal to the connection instruction unit, when the detection signal is input from the power switch.

2. The power control device according to claim 1, wherein the timer unit is installed on a wiring connecting the power source to a ground and has a time constant in which a charging voltage reaches a predetermined value, when the predetermined time has elapsed from the start time point of supply of the power, wherein the power control device includes an RC circuit that outputs the switch-on signal at a time point at which the charging voltage reaches the predetermined value, and a changeover switch that is installed between the ground and a wiring connecting the RC circuit and the connection instruction unit and switches between connection and non-connection of the RC circuit and the ground based on an instruction from the power control unit, wherein the connection instruction unit outputs the connection instruction signal for connecting the power source to the load to the power supply switch, when the switch-on signal is input from at least one of the power control unit and the RC circuit, and wherein the power control unit outputs, as the stop signal, a connection instruction signal for connecting the RC circuit to the ground to the changeover switch before a time point at which a charging voltage of the RC circuit reaches the predetermined value when the power is supplied from the power source, and the power control unit outputs the switch-on signal to the connection instruction unit when the detection signal is input from the power switch.

3. An electronic apparatus comprising:

the power control device according to claim 2;

an informing unit; and a control unit that drives and controls the informing unit, that serves as the load supplied with power from the power control device, wherein the control unit output a confirmation signal to the power control unit when the control unit is activated by supply of the power from the power control device, the control unit starts a predetermined normal operation performed at a time of power input when the control unit receives a reply signal to the confirmation signal from the power control unit, and the control unit causes the informing unit to inform of a warning of a user when the control unit does not receive the reply signal from the power control unit.

4. An image forming apparatus comprising:

the power control device according to claim 2;

an image forming unit that forms an image on a recording medium;

an informing unit; and a control unit that drives and controls the informing unit, that serves as the load supplied with power from the power control device, wherein the control unit outputs a confirmation signal to the power control unit when the control unit is activated by supply of the power from the power control device, the control unit starts a predetermined normal operation performed at a time of power input when the control unit receives a reply signal to the confirmation signal from the power control unit, and the control unit causes the informing unit to inform of a warning of a user when the control unit does not receive the reply signal from the power control unit.

5. The power control device according to claim 1, wherein the timer unit is a watchdog timer that starts timing from the start time point of supply of the power from the power source and outputs the switch-on signal at a time point at which the predetermined time has elapsed, and wherein the power control unit outputs, as the stop signal, a reset signal for resetting a timing time to the watchdog timer before a time point at which the watchdog timer times the predetermined time when the power is supplied from the power source, and the power control unit outputs the switch-on signal to the connection instruction unit when the detection signal is input from the power switch.

6. An electronic apparatus comprising:

the power control device according to claim 5;

an informing unit; and a control unit that drives and controls the informing unit, that serves as the load supplied with power from the power control device, wherein the control unit outputs a confirmation signal to the power control unit when the control unit is activated by supply of the power from the power control device, the control unit starts a predetermined normal operation performed at a time of power input when the control unit receives a reply signal to the confirmation signal from the power control unit, and the control unit causes the informing unit to inform of a warning of a user when the control unit does not receive the reply signal from the power control unit.

7. An image forming apparatus comprising:

the power control device according to claim 5;

an image forming unit that forms an image on a recording medium;

an informing unit; and a control unit that drives and controls the informing unit, that serves as the load supplied with power from the power control device, wherein the control unit output a confirmation signal to the power control unit when the control unit is activated by supply of the power from the power control device, the control unit starts a predetermined normal operation performed at a time of power input when the control unit receives a reply signal to the confirmation signal from the power control unit, and the control unit causes the informing unit to inform of a warning of a user when the control unit does not receive the reply signal from the power control unit.

8. An electronic apparatus comprising:

the power control device according to claim 1;

an informing unit; and a control unit that drives and controls the informing unit, that serves as the load supplied with power from the power control device, wherein the control unit outputs a confirmation signal to the power control unit when the control unit is activated by supply of the power from the power control device, the control unit starts a predetermined normal operation performed at a time of power input when the control unit receives a reply signal to the confirmation signal from the power control unit, and the control unit causes the informing unit to inform of a warning of a user when the control unit does not receive the reply signal from the power control unit.

9. An image forming apparatus comprising:

the power control device according to claim 1;

an image forming unit that forms an image on a recording medium;

an informing unit; and a control unit that drives and controls the informing unit, that serves as the load supplied with power from the power control device, wherein the control unit outputs a confirmation signal to the power control unit when the control unit is activated by supply of the power from the power control device, the control unit starts a predetermined normal operation performed at a time of power input when the control unit receives a reply signal to the confirmation signal from the power control unit, and the control unit causes the informing unit to inform of a warning of a user when the control unit does not receive the reply signal from the power control unit.

* * * * *